US007775412B2

(12) United States Patent
Nemeth

(10) Patent No.: US 7,775,412 B2
(45) Date of Patent: Aug. 17, 2010

(54) NAIL AND ANCHOR DRIVER

(76) Inventor: Andres Nemeth, 8981 Lake Park Cir. North, Davie, FL (US) 33328

( * ) Notice: Subject to any disclaimer, the term of this patent is extended or adjusted under 35 U.S.C. 154(b) by 91 days.

(21) Appl. No.: 12/266,900

(22) Filed: Nov. 7, 2008

(65) Prior Publication Data

US 2009/0120243 A1 May 14, 2009

Related U.S. Application Data

(60) Provisional application No. 61/002,362, filed on Nov. 8, 2007.

(51) Int. Cl.
*B25C 1/00* (2006.01)

(52) U.S. Cl. ..... 227/147; 227/113; 227/142; 173/90

(58) Field of Classification Search ..... 227/147, 227/142, 146, 134, 113; 173/90, 202
See application file for complete search history.

(56) References Cited

U.S. PATENT DOCUMENTS

| | | | | |
|---|---|---|---|---|
| 329,278 | A | | 10/1885 | Copeland |
| 452,519 | A | | 5/1891 | Fernald |
| 541,038 | A | | 6/1895 | Clark |
| 608,555 | A | | 8/1898 | Nazel |
| 620,426 | A | | 2/1899 | Danzer |
| 875,658 | A | | 12/1907 | Dutton |
| 1,127,838 | A | | 2/1915 | Willers |
| 1,155,724 | A | | 10/1915 | Harnly |
| 1,575,582 | A | | 3/1926 | Joy |
| 2,285,384 | A | | 6/1942 | Schott |
| 2,430,532 | A | | 11/1947 | Rayburn |
| 2,587,944 | A | | 3/1952 | Williams |
| 2,624,879 | A | | 1/1953 | Baird |
| 2,727,235 | A | | 12/1955 | Cameron |
| 2,767,399 | A | * | 10/1956 | Widener ..... 227/146 |
| 2,786,202 | A | | 3/1957 | Gaulke |
| 2,829,370 | A | | 4/1958 | Humbert |
| 2,902,690 | A | | 9/1959 | Hamlin |
| 2,973,527 | A | | 3/1961 | Maynard |
| 3,036,482 | A | | 5/1962 | Kenworthy |
| 3,119,423 | A | * | 1/1964 | Weick ..... 7/167 |
| 3,342,228 | A | | 9/1967 | Reid |
| 3,695,499 | A | * | 10/1972 | Taylor ..... 227/52 |
| 3,934,779 | A | | 1/1976 | Dent |
| 3,979,040 | A | | 9/1976 | Denin |
| 4,025,032 | A | * | 5/1977 | O'Neil et al. ..... 227/141 |
| 4,057,886 | A | * | 11/1977 | Brass ..... 29/235 |
| 4,085,882 | A | | 4/1978 | Stamper |
| 4,120,438 | A | | 10/1978 | Litch |
| 4,241,795 | A | | 12/1980 | Landry, Jr. |

(Continued)

*Primary Examiner*—Scott A. Smith
(74) *Attorney, Agent, or Firm*—Mark D. Bowen, Esq.; Malin Haley DiMaggio Bowen & Lhota, P.A.

(57) ABSTRACT

A nail is held within a cylindrical nail receiver by a magnetized tip of a cylindrical driver rod. As the driver sleeve is moved toward a surface, the driver rod drives the nail into the surface leaving a predetermine space between the head of the nail and the surface. A coil spring, attached to the nail receiver and allows for the nail receiver to be adjusted for several nail lengths thus allowing for an accurate placement of the nail against the wall. The nail receiver is interchangeable to allow use of the device with nails and anchors of differing diameters.

8 Claims, 1 Drawing Sheet

U.S. PATENT DOCUMENTS

| | | | | | |
|---|---|---|---|---|---|
| 4,252,259 | A | | 2/1981 | Brosius | |
| 4,299,021 | A | | 11/1981 | Williams | |
| 4,316,513 | A | | 2/1982 | Harris | |
| 4,367,836 | A | | 1/1983 | Hodson | |
| 4,483,475 | A | | 11/1984 | Whitaker | |
| 4,519,536 | A | * | 5/1985 | Steigauf | 227/147 |
| 4,562,948 | A | | 1/1986 | Floyd | |
| 4,709,841 | A | | 12/1987 | Wollar | |
| 4,785,692 | A | | 11/1988 | Holmes | |
| 4,834,342 | A | | 5/1989 | Padgett | |
| 4,838,471 | A | | 6/1989 | Chiesa | |
| 5,038,665 | A | | 8/1991 | Aske et al. | |
| 5,109,739 | A | | 5/1992 | Hull et al. | |
| 5,123,584 | A | | 6/1992 | Harrison | |
| 5,165,588 | A | | 11/1992 | Rowland | |
| 5,370,192 | A | | 12/1994 | Evinger | |
| 5,605,271 | A | | 2/1997 | Russell | |
| 5,779,128 | A | * | 7/1998 | Szczerba | 227/113 |
| 6,036,073 | A | | 3/2000 | Newhouse | |
| 6,402,007 | B1 | * | 6/2002 | Dyer | 227/147 |
| 6,585,142 | B1 | * | 7/2003 | Chen | 227/130 |
| 6,708,585 | B1 | | 3/2004 | Posenauer | |
| 6,783,048 | B2 | * | 8/2004 | Powell | 227/113 |
| 6,871,568 | B2 | | 3/2005 | Chen | |
| 6,968,989 | B1 | | 11/2005 | Hall, Jr. | |
| 7,287,680 | B2 | * | 10/2007 | Deziel | 227/110 |

* cited by examiner 10
20
22
24
60
50
52
100

10
20
22
24
60
50
52
100
A
A 20
24

10
20
22
24
26
60
62
28
30
40
32
34
35
42
64
50
52
100

NAIL AND ANCHOR DRIVER

CROSS REFERENCE TO RELATED APPLICATIONS

This application claims the benefit of provisional U.S. patent application Ser. No. 61/002,362, filed on Nov. 8, 2007.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

This invention relates in general to hand tools, and more particularly to hand tools for driving nails and drywall anchors.

2. Description of Related Art

There are many circumstances in which it is difficult to drive a nail or a drywall anchor, particularly using a hammer. For example, a vast number of individuals do not have experience using a hammer, and when a small nail needs to be placed on a wall—the inexperienced individual might end up hurting his fingers or damaging the wall with the hammer.

Hand held nail drivers have been devised for use in circumstances in which a hammer is impractical. For example, U.S. Pat. No. 4,483,475, issued Nov. 20, 1984, to Whitaker, discloses a simple hand held nail driver. The Whitaker device includes a cylindrical guide tube and a plunger rod. A handle is mounted on one end of the plunger rod, and the plunger rod is inserted into the guide tube. A nail is placed into the guide tube, and the handle is moved to cause the plunger rod to strike the nail, driving the nail into a surface. The guide tube is then held in place, as the handle is pulled back to retract the plunger rod from the guide tube.

Nail drivers having elongated tubular bodies receiving the fastener and a slidable impact rod are well known in the art, as shown in the following U.S. patents:

| | | |
|---|---|---|
| 608,555 | Nazel | Aug. 02, 1898 |
| 2,430,532 | Rayburn | Nov. 11, 1947 |
| 2,624,879 | Baird | Jan. 13, 1953 |
| 3,036,482 | Kenworthy | May 29, 1962 |
| 4,316,513 | Harris | Feb. 23, 1982 |
| 4,562,948 | Floyd | Jan. 07, 1986 |
| 4,709,841 | Wollar | Dec. 01, 1987 |

Furthermore, the following patents disclose impact fastener driver tools having magnetic heads for holding a fastener of ferro-magnetic material while it is being driven into a work surface:

| | | |
|---|---|---|
| 541,038 | Clark | Jun. 11, 1895 |
| 1,127,838 | Willers | Feb. 09, 1915 |
| 2,666,201 | Van Orden | Jan. 19, 1954 |
| 3,979,040 | Denin | Sep. 07, 1976 |
| 4,299,021 | Williams | Nov. 19, 1981 |

While the impact fastener driver tools disclosed in the prior art appear suitable for their intended purposes, there exists a need for an improved impact fastener driver tool that is simple, comfortable and easy to user, and simply adaptable for use with fasteners of different length and diameter.

BRIEF SUMMARY OF THE INVENTION

The present invention advances the art by providing a fastener driver for driving nails and/or anchors into drywall, without an external power source or an undue amount of physical exertion. A fastener driver in accordance with the present invention includes an ergonomic plunger handle, a driver rod connected to the handle, and a sleeve in surrounding relation with the driver rod, and an axially adjustable nail receiver connected to said sleeve, with said components being in generally concentric relation. A nail is held within the nail receiver by a magnetized tip affixed to the driver rod. The handle and attached driver rod are capable of reciprocal motion between retracted and extended configurations to urge the nail from the nail receiver into a wall. The ergonomic plunger is connected to the rearward end of the driver rod. As the ergonomic plunger is moved forward the tip of the driver rod moves forward within the nail chamber, driving the nail forward. A coil spring biases the driver rod to the retracted configuration.

The present invention provides a plurality of various sized nail chambers that may be selectively affixed to the driver rod sleeve. In addition, the nail receiver is axially adjustable so thereby allowing the user to set the device to drive the fastener a predetermined distance into the wall such that a predetermined desired length of the fastener protrudes. The distal end of the nail receiver includes an annular rubberized foot to prevent damage to the wall surface as the nail is driven in.

In accordance with these and other objects, which will become apparent hereinafter, the instant invention will now be described with particular reference to the accompanying drawings.

DETAILED DESCRIPTION OF THE INVENTION

Figures 1, 2, 3, 4:
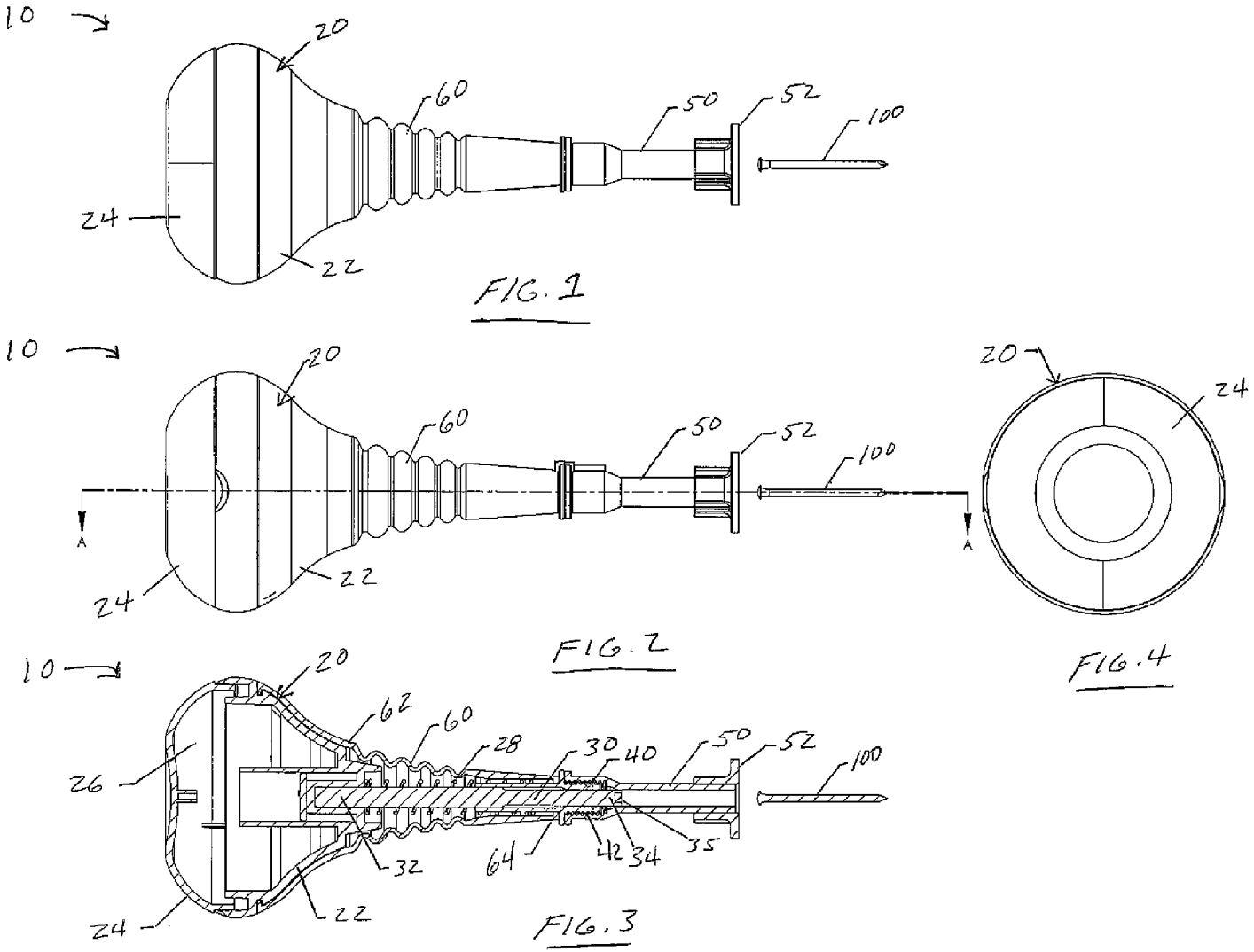
FIGS. 1 and 2 are side views of a nail/anchor driver in accordance with the present invention.
FIG. 3 is a side sectional view thereof taken along section line A-A of FIG. 2.
FIG. 4 is a handle end view thereof.

With reference now to the drawings, FIGS. 1-4 depict a preferred embodiment of a nail/anchor driver, generally referenced as 10, in accordance with the present invention. For the purpose of this disclosure, the nail/anchor driver shall be simply referred to as the "nail driver". It should be noted, however, that nail driver 10 may be used with a nail, a drywall anchor, or any other suitable fastener. Nail driver 10 is particularly adapted for driving nails and/or anchors into drywall, without an external power source or an undue amount of physical exertion.

Nail driver 10 includes an ergonomic plunger handle 20, a driver rod 30 connected to plunger handle 20, a sleeve 40 disposed in surrounding relation with driver rod 30, and a nail receiver 50 connected to said sleeve 40 and axially adjustable relative thereto. Plunger handle 20, driver rod 30, sleeve 40, and nail receiver 50 are preferably disposed in generally concentric relation as best illustrated in FIG. 3. A flexible cover 60 has a first end 62 connected proximal handle 20 and a second end 62 connected to sleeve 40. Flexible cover 60 functions to prevent the user's fingers from being pinched or otherwise interfering with the internal components. In a preferred embodiment, flexible cover 60 includes a mid-portion defining a sine wave shape to allow flexible cover 60 to expand and contract in accordion-like fashion.

A first significant aspect of the present invention involves providing handle 20 with an ergonomic rounded shape to provide a broad and comfortable grasping structure to allow the user to apply sufficient force to the handle without experiencing pain. Handle 20 also tapers radially inwardly toward the distal end thereof to allow the user's fingers to rest in a natural way over the handle body. In addition, handle 20 includes a base 22 and a cap 24 removably connected to base 22. Removal of cap 24 reveals an internal storage chamber 26 wherein accessories, such as fasteners, may be stored. In a preferred embodiment, cap 24 is in twist-lock removable engagement with base 22 such that the cap may be quickly attached and removed by clockwise and counterclockwise rotation of cap 24 relative to base 22. It should be noted, however, that cap 24 may be removably connected by twist-lock, snap fit, press fit, threaded engagement, or any other suitable means for connecting. At least a portion of flexible cover 60, or an additional rubberized component, forms an outer surface for handle 20 thereby providing cushioning for the handle.

Driver rod 30 is preferably an elongate rigid member having a proximal end 32 and a distal end 34 forming a generally blunt tip. As best illustrated in FIG. 3, driver rod proximal end 32 is connected handle 20 at base 22 such that driver rod distal end 34 projects from handle 20. Driver rod 30 may be formed of any suitably strong and preferably lightweight material. Driver rod distal end 20 further includes a magnet or magnetized tip 35 that functions to magnetically retain metallic fasteners as more fully discussed herein below. Sleeve 40 is disposed in surrounding relation with driver rod 30 such that driver rod 30 is capable of reciprocating motion through sleeve 40 between retracted and extended positions. A spring 28 has a first end in engagement with handle 20 and an opposing second end in engagement with sleeve 40, and biases driver rod 30 and handle 20 to the extended configuration. In the extended configuration, spring 28 is generally not in compression. In the retracted configuration, spring 28 is placed in compression.

Sleeve 40 includes an externally threaded distal end 42 to allow for removable and threaded engagement of sleeve 40 with a generally tubular nail receiver 50. Threaded engagement between the distal end 42 of sleeve 40 and rearward end of nail receiver 50 allows for selective axial adjustment of nail receiver 50 by rotation thereof relative to sleeve 40 thereby allowing for the use nails of varying length while further allowing the user to adjust the amount of the nail projecting from the wall. In addition, axial adjustment allows the tip of the fastener to be axially positioned generally flush with the wall allowing accurate placement into the wall. Further, it has been found desirable to have the tip of the fastener projecting slightly from nail receiver 50 to allow for accurate alignment and targeting of the nail with the intended nail insertion point. The connection of receiver 20 by engagement of female connection structure 24 with male connection structure 26 may be by twist-lock, snap fit, press fit, threaded engagement, or any other suitable means for connecting. Nail receiver 50 includes an open forward or distal end having an annular resilient rubber foot 52 that prevents damage, indentation, or marking of the wall. Further, the forward end may be angled to allow for nails to be driven into a surface at a suitable angle. In a preferred embodiment, various sizes of nail receivers are provided. Each nail receiver may be selectively affixed to sleeve 40 thereby allowing nail driver 10 to be used with fasteners and the like of various length and diameters. For example, nail and anchor head sizes can range from 2.0 mm to 1.0 cm in diameter and from 1.5 cm to 7.5 cm in length. As should be apparent, additional nail receivers may be stored in chamber 26 in handle 20.

Operation and Use

The operation and use of nail driver 10 will now be described. A fastener 100, such as a nail, is received within nail receiver 50 of nail driver 10 prior to use. As noted above, fasteners may be stored in handle chamber 26 and accessed by removal of cap 24. The magnetized tip 35 at the distal end 34 of driver rod 30 functions to magnetically secure the fastener within nail receiver 50. Accordingly, the head of fastener 100 is held against the magnetized tip 35 so that the shaft of the nail is held generally centered within the nail receiver 50. Next the nail receiver may be adjusted to accommodate the length of the nail and/or to result in a predetermined length of the nail to project from annular resilient foot 52 at the distal end of nail receiver 50. Axial adjustment is accomplished by rotating nail receiver 50 relative to sleeve 40 thereby lengthening or shortening the effective length of the nail receiving chamber.

Next, annular resilient rubber foot 52 is placed against the wall at the point at which the nail 100 is to be driven. As should be apparent, the ergonomic plunger handle 20 allows nail driver 10 to be held in place by the user with one hand. With that hand, ergonomic plunger handle 20 is pushed forward, causing driver rod 30, and the nail that is magnetically secured at tip 35 by magnet 35, to move through sleeve 40 and retract into nail receiver 50 thereby compressing spring 28. As the ergonomic plunger handle is moved forward the distal end 34 of driver rod 30 moves forward within nail receiver 50, driving the nail forward and into the wall. When the user releases hand pressure applied to ergonomic handle 20, coil spring 28 causes the nail driver 10 to return to extended position.

The nail driver 10 of the invention has several advantages over the prior art. One such advantage relates to providing interchangeable nail receivers to allow for the use of various fasteners (e.g. nails, anchors, etc.) of various lengths and diameters. Providing a matching nail receiver to closely fit the nail head is critical in ensuring that the nail is centered within the nail receiver so as to provide for precise placement of the nail in the wall. Another advantage relates to providing a nail driver that allows various adjustments to accommodate nails and anchors of differing length by allowing simple axial adjustment by rotation of the nail receiver as disclosed above. In cases wherein the nail head does not closely fit within the nail receiver it has been found that centering the nail is virtually impossible. The nail driver of the present invention compensates for such situations by allowing an adjustment of the nail receiver to the nails length thereby allowing the user to expose only a small portion of the nail tip and pressing the tip to the desired exact position just before the nail is driven into the wall.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A nail driver for driving a nail into a surface, the nail driver comprising:

an handle defining an ergonomically sized rounded end;

an elongate driver rod connected having a proximal end connected to said handle and a distal end forming a blunt tip;

a tubular sleeve disposed in surrounding relation with said driver rod, said tubular sleeve having a distal end;

a nail receiver having a rearward end removably connected to the distal end of said tubular sleeve, and a forward end;

means for axially adjusting said nail receiver;

said driver rod movable between an extended position wherein said blunt tip is in proximity to said nail receiver rearward end and a retracted position wherein said blunt tip is in proximity to said nail receiver forward end; and means for biasing said driver rod to said extended position;

whereby a nail received within said nail receiver may be driven into a surface by placing said nail receiver forward end against the surface and applying a force to said handle so as to move said driver rod to said retracted position thereby driving the nail from said nail receiver forward end.

2. A nail driver according to claim 1, wherein said handle defines and internal storage chamber and a remvoably attached cap disposed in covering relation with said storage chamber.

3. A nail driver according to claim 1, wherein said handle includes a resilient outer surface.

4. A nail driver according to claim 1, wherein said means for axially adjusting said nail receiver includes threaded engagement between said nail receiver and said tubular sleeve, wherein rotation of said nail receiver relative to said tubular member changes the relative axial position of said nail receiver relative to said tubular sleeve.

5. A nail driver according to claim 1, wherein said driver rod blunt tip is magnetized.

6. A nail driver according to claim 1, wherein said nail receiver forward end includes a resilient foot.

7. A nail driver for driving a nail or other fastener having an outer diameter into a surface, the nail driver comprising:

an handle defining an ergonomically sized rounded end, said handle including an internal storage compartment and an openable closure for providing access to said storage compartment, said handle tapering radially inwardly and distally from said rounded end;

an elongate driver rod connected having a proximal end connected to said handle and a distal end forming a blunt tip, said distal end including a magnet;

a tubular sleeve disposed in surrounding relation with said driver rod, said tubular sleeve having a distal end;

first and second nail receivers, each nail receiver having a rearward end and a forward end with a resilient foot attached to said forward end, one nail receiver having said rearward end connected to said tubular sleeve distal end;

means for axially adjusting said one nail receiver;

said driver rod movable between an extended position wherein said blunt tip is in proximity to said one nail receiver rearward end and a retracted position wherein said blunt tip is in proximity to said one nail receiver forward end; and a coil spring in surrounding relation with said driver rod, said spring having a first end connected to said handle and a second end connected to said tubular sleeve;

whereby a nail received within said nail receiver may be driven into a surface by placing said nail receiver forward end against the surface and applying a force to said handle so as to move said driver rod to said retracted position thereby driving the nail from said nail receiver forward end.

8. A nail driver according to claim 7, wherein said handle includes a resilient outer surface.

* * * * *